US010240275B1

(12) United States Patent
Groves

(10) Patent No.: US 10,240,275 B1
(45) Date of Patent: Mar. 26, 2019

(54) WASHER/DRYER LAUNDRY HANDLING SYSTEM

(71) Applicant: Darell F. Groves, Seminole, FL (US)

(72) Inventor: Darell F. Groves, Seminole, FL (US)

( * ) Notice: Subject to any disclaimer, the term of this patent is extended or adjusted under 35 U.S.C. 154(b) by 0 days.

(21) Appl. No.: 16/153,390

(22) Filed: Oct. 5, 2018

Related U.S. Application Data

(60) Provisional application No. 62/644,224, filed on Mar. 16, 2018.

(51) Int. Cl.

| | |
|---|---|
| ***D06F 58/20*** | (2006.01) |
| ***D06F 58/02*** | (2006.01) |
| ***D06F 29/00*** | (2006.01) |
| ***D06F 39/00*** | (2006.01) |
| ***D06F 95/00*** | (2006.01) |

(52) U.S. Cl.
CPC ..... *D06F 58/20* (2013.01); *D06F 29/005* (2013.01); *D06F 39/00* (2013.01); *D06F 58/02* (2013.01); *D06F 95/00* (2013.01); *D06F 95/002* (2013.01)

(58) Field of Classification Search
CPC ..... D06F 58/20; D06F 25/00; D06F 29/005; D06F 39/00; D06F 98/02; D06F 98/002; B65G 11/00; B65G 11/02; B65G 11/10; B65G 11/103; B65G 11/106
See application file for complete search history.

(56) References Cited

U.S. PATENT DOCUMENTS

| | | | | | |
|---|---|---|---|---|---|
| 2,133,540 | A * | 10/1938 | Jacobs | A61G 5/08 | 297/42 |
| 2,508,268 | A * | 5/1950 | Knowlton | D06F 95/00 | 68/210 |
| 2,904,897 | A * | 9/1959 | Whyte | D06F 95/004 | 34/90 |
| 3,464,733 | A * | 9/1969 | Shaw | B65D 88/1612 | 294/68.21 |
| 3,505,836 | A * | 4/1970 | Langston | D06F 39/12 | 68/208 |
| 3,583,748 | A * | 6/1971 | Arndt | D06F 95/004 | 193/25 C |
| 4,015,930 | A * | 4/1977 | Grantham | D06F 58/02 | 34/129 |
| 4,835,993 | A * | 6/1989 | Dreher | D06F 95/00 | 68/142 |
| 5,357,772 | A * | 10/1994 | Hendren | D06F 95/00 | 68/210 |
| 5,449,083 | A * | 9/1995 | Dougherty | A01D 51/00 | 220/9.1 |
| 5,700,293 | A * | 12/1997 | Rydell | D06F 93/00 | 232/1 B |
| 6,463,768 | B1 * | 10/2002 | Shaw | D06F 95/00 | 68/210 |
| 6,671,978 | B1 * | 1/2004 | McGowan | D06F 29/00 | 34/527 |
| 2004/0123635 | A1 * | 7/2004 | Harfmann | D06F 95/00 | 68/210 |

(Continued)

*Primary Examiner* — Joseph L. Perrin

(57) ABSTRACT

A chute fabricated of a polymer has an arcuate leading edge, an arcuate trailing edge, a left edge, a right edge, a top surface, and a bottom surface. The chute has a centerline extending between the leading edge and the trailing edge. The centerline is equally spaced from the left edge and the right edge. The chute is curved with an axis of rotation parallel with and elevationally above the centerline and spaced from the centerline and the top surface.

6 Claims, 3 Drawing Sheets

(56) References Cited

U.S. PATENT DOCUMENTS

| | | | | |
|---|---|---|---|---|
| 2005/0076454 | A1* | 4/2005 | Duffy | D06F 37/10 8/158 |
| 2007/0113599 | A1* | 5/2007 | Harfmann | D06F 95/00 68/235 R |
| 2013/0014403 | A1* | 1/2013 | Blair | B65G 11/203 34/165 |

* cited by examiner

FIG. 4
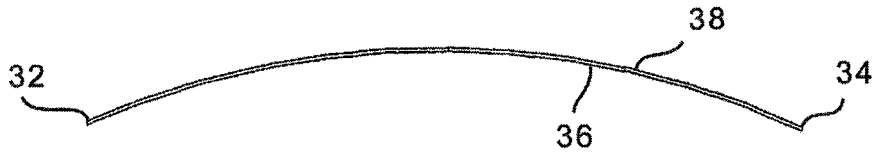
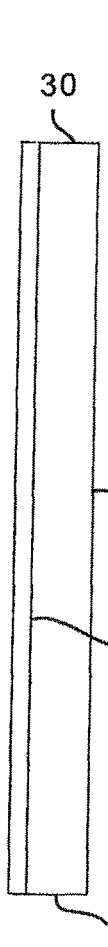
FIG. 5
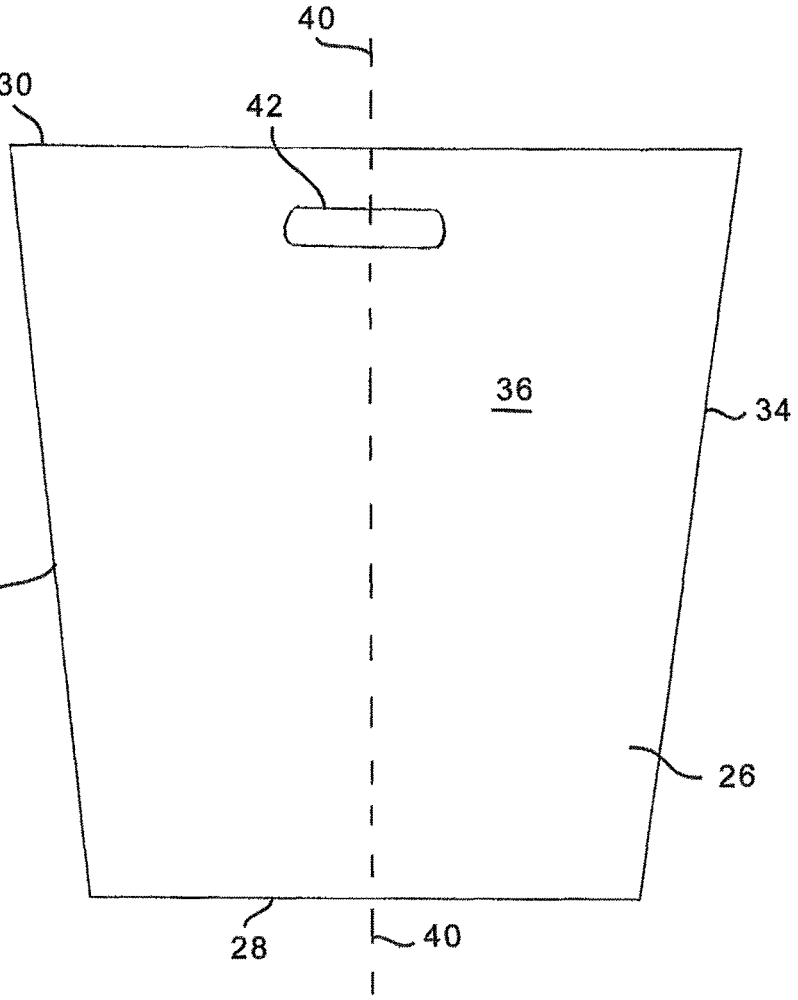
FIG. 3

WASHER/DRYER LAUNDRY HANDLING SYSTEM

RELATED APPLICATION

The present invention is based upon Provisional Application No. 62/644,224 filed Mar. 16, 2018, the subject matter of which is incorporated herein by reference.

BACKGROUND OF THE INVENTION

Field of the Invention

The present invention relates to a washer/dryer laundry handling system and more particularly pertains to facilitating the transfer of washed laundry from a washer to a dryer and for minimizing the physical strain on a person doing laundry. The facilitating of the transfer and the minimizing of the physical strain are done in a safe, convenient, and economical manner.

Description of the Prior Art

The use of laundry systems of known designs and configurations is known in the prior art. More specifically, laundry systems of known designs and configurations previously devised and utilized for the purpose of handling laundry are known to consist basically of familiar, expected, and obvious structural configurations, notwithstanding the myriad of designs encompassed by the crowded prior art which has been developed for the fulfillment of countless objectives and requirements.

While these devices fulfill their respective, particular objectives and requirements, they do not describe a washer/dryer laundry handling system that allows for facilitating the transfer of washed laundry from a washer to a dryer and for minimizing the physical strain on a person doing laundry. The facilitating of the transfer and the minimizing of the physical strain are done in a safe, convenient, and economical manner.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

Therefore, it can be appreciated that there exists a continuing need for a new and improved washer/dryer laundry handling system which can be used for facilitating the transfer of washed laundry from a washer to a dryer and for minimizing the physical strain on a person doing laundry. The facilitating of the transfer and the minimizing of the physical strain are done in a safe, convenient, and economical manner. In this regard, the present invention substantially fulfills this need.

SUMMARY OF THE INVENTION

In view of the disadvantages inherent in the known types of laundry systems of known designs and configurations now present in the prior art, the present invention provides an improved washer/dryer laundry handling system. As such, the general purpose of the present invention, which will be described subsequently in greater detail, is to provide a new and improved washer/dryer laundry handling system and method which has all the advantages of the prior art and none of the disadvantages.

To attain this, the present invention essentially comprises in this broad context, a chute. The chute has an arcuate leading edge, an arcuate trailing edge, a left edge, a right edge, a top surface, and a bottom surface. The chute is fabricated of a polymer. The chute has a centerline extending between the leading edge and the trailing edge. The centerline is equally spaced from the left edge and the right edge. The chute is curved with an axis of rotation parallel with and elevationally above the centerline and spaced from the centerline and the top surface.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the invention be regarded as including such equivalent constructions insofar as they do not depart from the spirit and scope of the present invention.

It is therefore an object of the present invention to provide a new and improved washer/dryer laundry handling system which has all of the advantages of the prior art laundry systems of known designs and configurations of known designs and configurations and none of the disadvantages.

It is another object of the present invention to provide a new and improved washer/dryer laundry handling system which may be easily and efficiently manufactured and marketed.

It is further object of the present invention to provide a new and improved washer/dryer laundry handling system which is of durable and reliable constructions.

Lastly, it is an even further object of the present invention is to provide a new and improved washer/dryer laundry handling system which is susceptible of a low cost of manufacture with regard to both materials and labor, and which accordingly is then susceptible of low prices of sale to the consuming public, thereby making such washer/dryer laundry handling system economically available to the buying public.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a front elevational view of the chute shown in FIG. 2.

FIG. 4 is a plan view of the chute shown in FIG. 2.

FIG. 5 is a left side elevational view of the chute shown in FIG. 2.

The same reference numerals refer to the same parts throughout the various Figures.

DESCRIPTION OF THE PREFERRED EMBODIMENT

Figure 1:
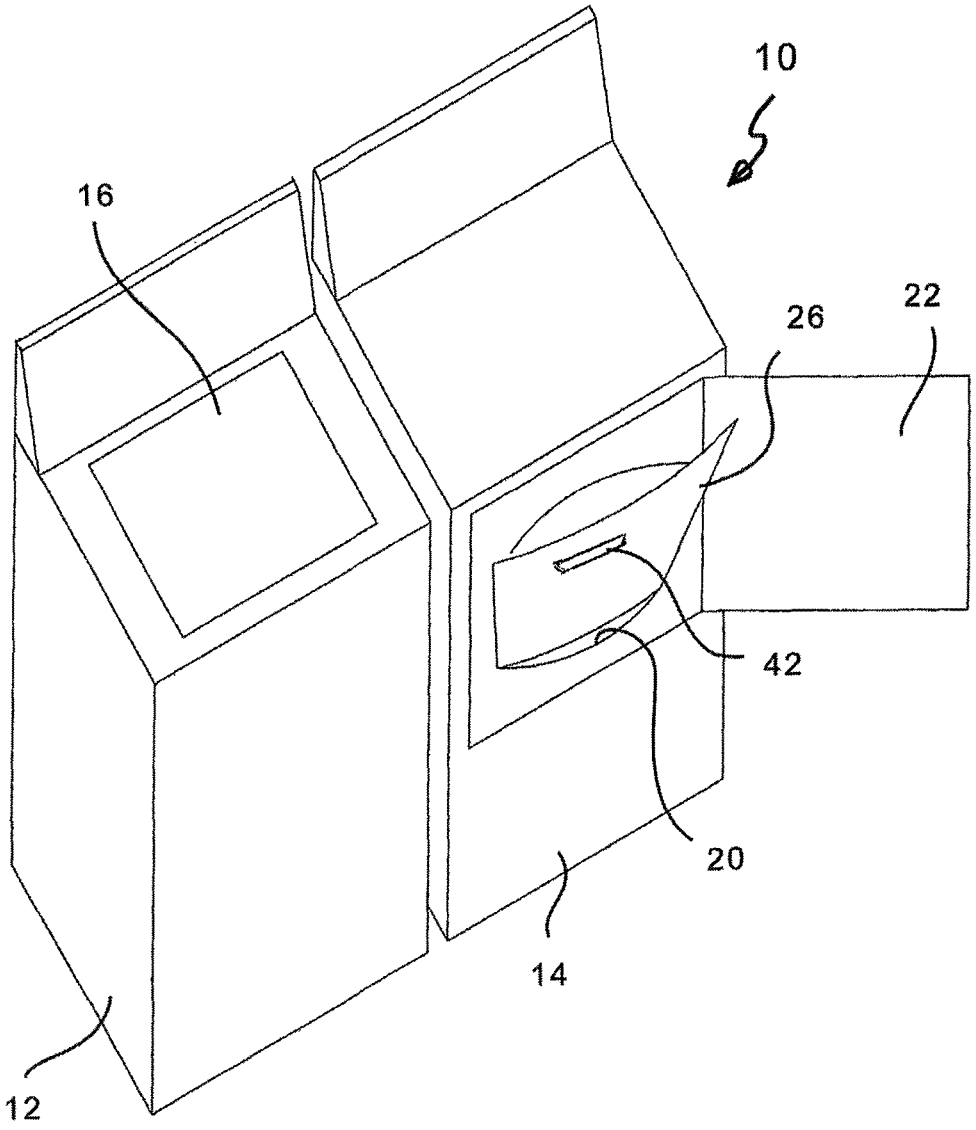
FIG. 1 is a perspective illustration of a washer/dryer laundry handling system constructed in accordance with the principles of the present invention.
Figure 2:
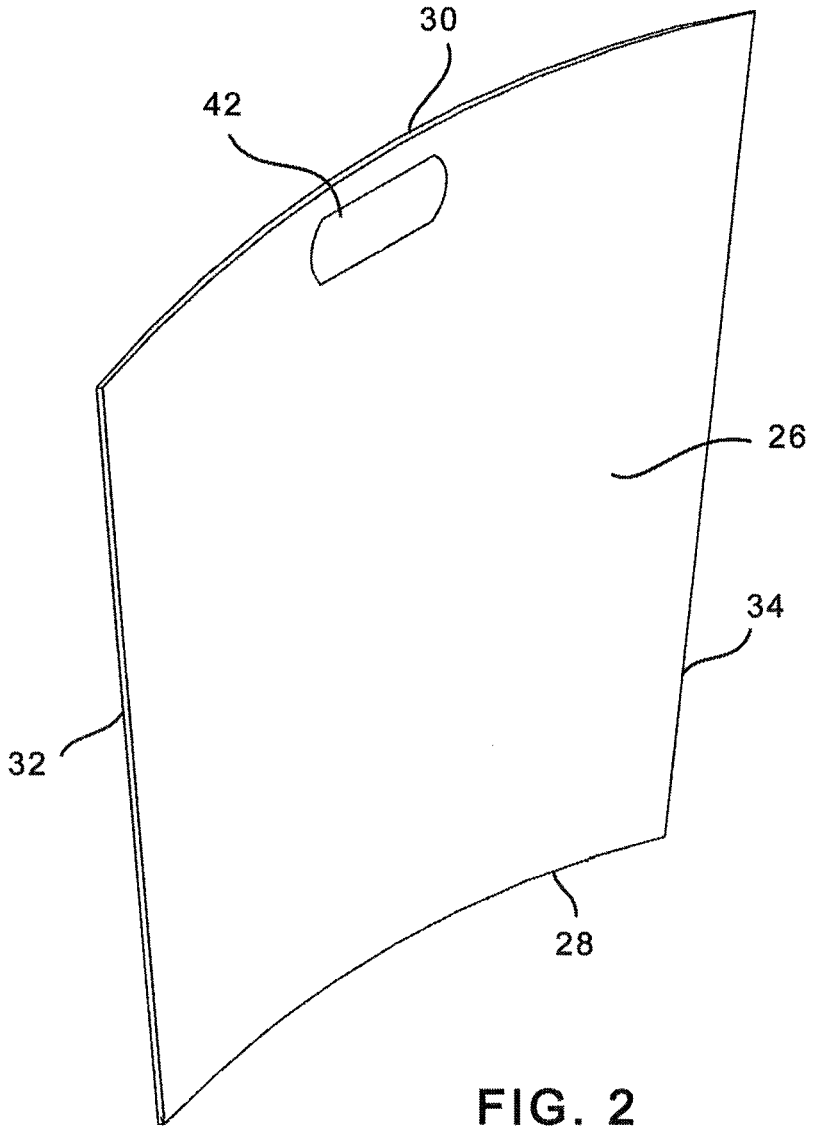
FIG. 2 a perspective illustration of the chute shown in FIG. 1.

With reference now to the drawings, and in particular to FIG. 1 thereof, the preferred embodiment of the new and improved washer/dryer laundry handling system embodying the principles and concepts of the present invention and generally designated by the reference numeral 10 will be described.

The present invention, the washer/dryer laundry handling system in the broadest context is comprised of a chute. The chute is configured so as to attain the desired objective.

XCLIENTTEXT (sometimes there is no client text) In the preferred embodiment of the washer/dryer laundry handling system, from a specific context, designated by reference numeral 10, first provided is a washer 12. The washer is generally rectilinear in configuration. The washer has a front, a back, a left side, a right side, a bottom, and a top. The top has a lid 16. The lid is movable between an open position and a closed position. The open position facilitates moving laundry into and out of the washer.

A dryer 14 is provided. The dryer is generally rectilinear in configuration. The dryer has a top, a bottom, a left side, a right side, a back, and a front. The front has a circular opening 20. The front of the dryer has a door 22. The door is movable between an open position and a closed position. The open position facilitates moving laundry into and out of the dryer.

Further provided is a chute 26. The chute has an arcuate leading edge 28 having a length of 17 inches, plus or minus 10 percent. The chute has an arcuate trailing edge 30 having a length of 22 inches, plus or minus 15 percent. The chute has a linear left edge 32 and a linear right edge 34. The chute has a top surface 36 and a bottom surface 38. The chute has a thickness of 0.125 inches, plus or minus 15 percent. The chute is fabricated of a polymer chosen from the class of polymers consisting of plastic and rubber, natural and synthetic, and blends thereof. The chute has a centerline 40. The centerline extends between the leading edge and the trailing edge. The centerline has a length of 24 inches, plus or minus 10 percent. The centerline is equally spaced from the left edge and the right edge. The chute is curved with a radius of curvature of 20 and 28 inches and an axis of rotation parallel with and elevationally positioned above the centerline and spaced from the centerline and the top surface by a height of 3.50 to 4.00 inches, plus or minus 15 percent. All corners are rounded to a 0.50 inch radius. A slot 42 is provided through the chute adjacent to and parallel with the upper edge. In this manner the slot functions as a handle. The chute is positionable with the lid and door open and the lower end of the chute inside of the dryer and with the bottom surface of the chute in contact with the circular opening. In this manner a user may stand and move wet laundry from the washer to the top of the chute for movement into the dryer without standing and bending in continuous energy wasting movements.

Note is taken that in the preferred embodiment, all four edges are linear prior to the curvature being formed around the centerline of the chute. The chute is flat with the capability to be bent due to its flexibility to form an arcuate edge. It should be understood, however, that any of the edges may be arcuate. For example, the side edges may be smooth curves, preferably with the narrowest width at the leading lower edge.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A washer/dryer laundry handling system 10 comprising:

a chute (26) having an arcuate leading edge (28), an arcuate trailing edge (30), a left edge (32), a right edge (34), a top surface (36), and a bottom surface (38), the chute being fabricated of a polymer, the chute having a centerline extending between the leading edge and the trailing edge, the centerline being equally spaced from the left edge and the right edge, the chute being curved with an axis of rotation parallel with and elevationally above the centerline and spaced from the centerline and the top surface, the chute being flexible allowing bending to configure the arcuate leading edge and the arcuate trailing edge;

a top loading washer (12) having a front, a back, a left side, a right side, a bottom, and a top, the top having a lid (16) movable between an open position and a closed position, the open position being for moving laundry into and out of the washer; and a front loading dryer (14) having a top, a bottom, a left side, a right side, a back and a front, the front having a circular opening (20) and a door (22) movable between an open position and a closed position, the open position being for moving laundry into and out of the dryer, the chute being positionable with the lid and door open and the lower end of the chute inside of the dryer and with the bottom surface of the chute in contact with the circular opening whereby a user may stand and move wet laundry from the washer to the top of the chute for movement into the dryer without standing and bending in continuous energy wasting movements.

2. The system as set forth in claim 1 and further including:

a slot (42) extending through the chute adjacent to and parallel with the upper edge for functioning as a handle.

3. The system as set forth in claim 2 wherein:

the arcuate leading edge of the chute has a length of 17 inches plus or minus 10 percent, the arcuate trailing edge has a length of 22 inches plus or minus 15 percent, the left edge is linear, the right edge is linear, the top surface and the bottom surface have a thickness of 0.125 inches plus or minus 15 percent, the centerline has a length of 24 inches plus or minus 10 percent, the chute has a radius of curvature of from 20 to 28 inches spaced from the centerline and top surface by a height of 3.50 inches to 4.00 inches, plus or minus 15 percent, and all corners are rounded to a 0.50 inch radius.

4. The system as set forth in claim 1 wherein the side edges are cut by a die cutting machine and the curve of the chute is formed by a heat tunnel machine.

5. The system as set forth in claim 1 wherein the side edges and the curve are formed by a heat tunnel machine.

6. A washer/dryer laundry handling system (10) for facilitating the transfer of washed laundry from a washer (12) to a dryer (14) and for minimizing the physical strain on a person doing laundry, the system comprising, in combination:

the washer (12) having a generally rectilinear configuration with a front, a back, a left side, a right side, a bottom, and a top, the top having a lid (16) movable between an open position and a closed position, the open position being for moving laundry into and out of the washer, the dryer (14) having a generally rectilinear configuration with a top, a bottom, a left side, a right side, a back and a front, the front having a circular opening (20) and a door (22) movable between an open position and a closed position, the open position being for moving laundry into and out of the dryer; and a chute (26) having an arcuate leading edge (28) with a length of 17 inches plus or minus 10 percent, an arcuate trailing edge (30) with a length of 22 inches plus or minus 15 percent, a linear left edge (32), a linear right edge (34), a top surface (36), and a bottom surface (38) with a thickness of 0.125 inches plus or minus 15 percent, the chute being fabricated of a polymer chosen from the class of polymers consisting of plastic and rubber, natural and synthetic, and blends thereof, the chute having a centerline (40) extending between the leading edge and the trailing edge with a length of 24 inches plus or minus 10 percent, the centerline being equally spaced from the left edge and the right edge, the chute being flexible allowing bending to configure the arcuate leading edge and the arcuate trailing edge; the chute being curved with a radius of curvature of from 20 to 28 inches and an axis of rotation parallel with and elevationally positioned above the centerline and spaced from the centerline and the top surface by a height of 3.50 inches to 4.00 inches, plus or minus 15 percent, all corners being rounded to a 0.50 inch radius, a slot (42) extending through the chute adjacent to and parallel with the upper edge for functioning as a handle, the chute being positionable with the lid and door open and the lower end of the chute inside of the dryer and with the bottom surface of the chute in contact with the circular opening whereby a user may stand and move wet laundry from the washer to the top of the chute for movement into the dryer without standing and bending in continuous energy wasting movements.

* * * * *